United States Patent [19]

Ogden

[11] Patent Number: 4,602,779

[45] **Date of Patent: * Jul. 29, 1986**

[54] EXERCISE TREADMILL

[75] Inventor: Ralph Ogden, Munster, Ind.

[73] Assignee: Ajax Enterprises Corporation, Delavan, Wis.

[ * ] Notice: The portion of the term of this patent subsequent to Aug. 17, 1999 has been disclaimed.

[21] Appl. No.: 552,803

[22] Filed: Nov. 17, 1983

Related U.S. Application Data

[63] Continuation-in-part of Ser. No. 378,627, May 17, 1982, Pat. No. 4,445,683, which is a continuation-in-part of Ser. No. 226,766, Jan. 21, 1981, Pat. No. 4,374,587, which is a continuation-in-part of Ser. No. 175,516, Aug. 6, 1980, Pat. No. 4,344,616.

[51] Int. Cl.[4] ..... A63B 23/06

[52] U.S. Cl. ..... 272/69; 198/846

[58] Field of Search ..... 272/72, 69; 119/29; 198/806, 844, 846

[56] References Cited

U.S. PATENT DOCUMENTS

| | | | |
|---|---|---|---|
| D. 211,801 | 7/1968 | Quinton | D34/5 |
| D. 270,555 | 9/1983 | Ogden | D21/192 |
| 759,296 | 5/1904 | Moriarty | 272/69 |
| 3,637,206 | 1/1972 | Chickering, III | 272/69 |
| 3,643,943 | 2/1972 | Erwin et al. | 272/69 |
| 3,659,845 | 5/1972 | Quinton | 272/69 |
| 3,703,284 | 11/1972 | Hesen | 272/69 |
| 4,227,487 | 10/1980 | Davis | 119/29 |
| 4,344,616 | 8/1982 | Ogden | 272/69 |
| 4,364,556 | 12/1982 | Otte | 272/69 |
| 4,374,587 | 2/1983 | Ogden | 272/69 |

FOREIGN PATENT DOCUMENTS

| | | | |
|---|---|---|---|
| 2919494 | 11/1980 | Fed. Rep. of Germany | 272/69 |
| 556075 | 9/1943 | United Kingdom | 193/806 |

*Primary Examiner*—Richard J. Apley
*Assistant Examiner*—S. R. Crow
*Attorney, Agent, or Firm*—Mann, McWilliams, Zummer and Sweeney

[57] ABSTRACT

A treadmill exercising apparatus comprising a generally planar frame equipped with an inclinable, planar slider bed, a driving head roller, and an idler tail roller, both journalled in the slider bed and respectively at the head and tail ends of the frame, over which an endless belt, formed by a low long term creep or stretch resistant synthetic resin extruded film, oriented of polyester or nylon, is trained, with the slider bed having a top slider surfacing formed from one of the same materials or from Masonite hardboard sheeting, across which the upper run of the belt rides, with the head and tail rollers each being formed from a rigid metallic material and provided with a belt centering crown, which, at least in the case of the driving head roller, is provided with an elastomeric coating or covering that defines the crown surfacing, whereby the coefficient of dynamic friction of the belt riding on the treadmill slider bed is no more than about 0.22, while the coefficient of static friction between the crown surfacing of the treadmill driving roller and the belt is no less than about 0.4, with the belt also being adjustably tension against the rollers to be in slip free tight relation thereto under a tension that is a nominal fraction of the tensile strength of the belt, thereby providing maximized driving efficiency with minimum energy requirements that permit the use of an electric drive motor for walking exercise use of the treadmill that may be less than one horsepower.

17 Claims, 19 Drawing Figures

10
29
280
282
286
285
287
284
12
13
289
294
290
291
292
42
54
340
204
201
211
203
18
209
202
206
207
208
4
272
236
306
310
126
136
25
7
3
104
122
186
192
182
142
180
184

64
60
22
85
85A
85B
85C
85D
85E
87
89
100
138A
220
223
224
228
234
236
238
250
252
254
256
260
262
264
265
266
267
268
269
270
272
284
289
290
291
292
293
312A
314A
364
366
368
372
374
376
380
382
384
386
388
54
70
106
106A 35
26
32
35
35
50
35
35
35
35
35
35
24A
24B
-24-
27
24S
52

51
55
26
26S
32
51
55
52
51
55
35
35
53
54

EXERCISE TREADMILL

This application is a continuation-in-part of my application Ser. No. 378,627, filed May 17, 1982, now U.S. Pat. No. 4,445,683, granted May 1, 1984, which is a continuation-in-part of my application Ser. No. 226,766, filed Jan. 21, 1981, now U.S. Pat. No. 4,374,587, granted Feb. 22, 1983, which in turn was a continuation-in-part of my application Ser. No. 175,516, filed Aug. 6, 1980, now U.S. Pat. No. 4,344,616 granted Aug. 17, 1982.

This invention relates to an exercise treadmill, and more particularly to an exercise treadmill of the endless belt type on which the exerciser may walk for exercise purposes, this application being directed to improvements on the arrangements of my said U.S. Pat. Nos. 4,344,616, 4,374,587, and 4,445,685.

Various forms and types of treadmill assemblies are and have been available for exercise purposes involving endless belts on which the user walks or trots for exercise or diagnostic purposes. However, the equipment of this type that has been available prior to the Applicant's inventions has proved to be unduly expensive to be practical for individuals to have at home for regular exercise use, due to the tendency to incorporate sophisticated monitoring equipment and the overdesigning of the basic apparatus to insure continuous exercise for individuals weighing up to 250 pounds or more, and yet permitting adjustment in slope and speed to make available to the user mild to exhaustive exercise for testing or conditioning purposes.

A principal object of the present invention is to providing a walking exercise treadmill of few and simple parts that avoids costly sophisticated instrumentation and other equipment not essential to exercise use as such, while providing the user with ready infinitely variable slope adjustment between zero and a predetermined maximum, such as 25 percent, a suitable selection of belt speed adjustments that provide treadmill belt speed levels that are reliable and consistently at the preset rates, minimized power driving requirements for the belt that permit the facile use of an electric drive motor of only one half horsepower or less to drive the treadmill belt, and an endless belt type treadmill in which the belt has low long term creep or stretch resistance characteristics and requires only a modest tensioning and adjustment of same to maintain the belt in desired driving relation with its training rollers.

Another principal object of the present invention is to provide an exercise treadmill that essentially comprises a slider bed type, endless belt trained, frame assembly, characterized by the belt and slider bed surfacing it rides on being formed of low dynamic friction providing materials that are lubricant free and have long term wear characteristics, and providing for manually operable stepless slope selectability between zero and a predetermined maximum slope, with the frame support being arranged to automatically increase stability as the slope is increased to the maximum provided for, and the belt being of low cost extruded resinous plastic film construction having low long term creep or stretch resistance characteristics under training tension while providing for increased heat dissipation and ease of cleaning.

Another important object of the invention is to provide an exercise treadmill that has minimal space requirements for storage and use, that has minimal driving energy requirements in use that are uniform for the respective speed levels selected, that has nominal maintainence requirements, and that is long lived and effective in use, and is essentially free of undue belt creep or stretch, or changes in minimal driving energy requirements on a long term, frequent use basis.

In accordance with the invention, an exercise treadmill is provided comprising a generally planar frame or platform or deck providing a slider bed, and a driving head roller and an idler tail roller at the corresponding ends of the slider bed, over which is trained an endless belt formed from a low long term creep or stretch resistance synthetic film material, such as oriented polyester film or oriented nylon film, the upper run of which rides on a wet lubricant free facing of the slider bed that is preferably formed from one of the same synthetic resinous materials that the belt is formed from, or alternately, hardboard of the compressed wood type. The head and tail rollers are, on the other hand, formed from a rigid metallic material such as steel, and each is provided with a belt centering crown which, at least in the case of the driving head roller, is coated or covered with an elastomeric material, such as urethane rubber or nitrile rubber, to define the roller crown surfacing that is to engage the underside of the belt. The treadmill frame adjacent to and spaced forwardly of its head is provided with a cross member fixed thereto in which a slope adjusting device in the form of a pair of spaced apart screw members is provided for supporting and changing the elevation of the frame head end to provide the slope, if any, desired for the treadmill, as disclosed in my said U.S. Pat. No. 4,344,616. Each such screw member of the slope adjusting device is individually rotationally journalled in its own supporting foot that is arranged to permit rocking relation of the screw members with respect to the floor or other supporting surface of the treadmill. The tail end of the treadmill frame is arranged to adjustably provide a slip free tension tightness of the belt about its training rollers with minimized tension in the belt, over an adjustment range that is commensurate with the low long term creep of the belt under the tensioning of same needed in accordance with the invention that is effective for the active useful life of the apparatus, assuming regular use.

The tail end of the frame is equipped with a pair of spaced apart pivotally mounted feet, with the treadmill feet at both ends of the frame being proportioned so that the treadmill slider bed and cooperating belt are horizontally disposed when the slope adjusting device screw members are in their retracted positions, with the slider bed and cooperating belt being angled upwardly at the predetermined maximum slope to be provided by the treadmill when the screw members are in their extended substantially vertical relations.

The treadmill belt is power driven through its driving head roller by a suitable low power electric motor carried by the treadmill frame indicated cross member, with stepped pulleys being provided for stepping down of the drive rpm, and belt speed adjustment being provided for to provide belt movement at several selected speeds, such as 2, 2.9, and 3.5 miles per hour for walking exercise. The treadmill assembly or unit is equipped on either side of same with a hand hold railing of P shaped configuration of which the head end of the railing configuration is positioned with the cantilever portion of the head (of the railing configuration) directed rearwardly for convenient grasping as needed by the user in mounting and stepping off the treadmill belt from either side of the treadmill assembly or unit.

The treadmill belt, drive roller, slider bed surfacing, and other improvements provided by the invention result in the provision of a simplified, inexpensive, low maintainence, walking type exercise treadmill of maximized driving efficiency with minimum energy requirements that permits use of an electric drive motor, to drive the treadmill belting, of less than 1 horsepower for a walking exercise user having a weight of up to about 200 pounds.

The screw members of the slope adjusting device are threadedly mounted in the treadmill frame cross member by way of a special pair of nut assemblies associated therewith (as per my U.S. Pat. No. 4,374,587), and the belt drive assembly includes a motor mounting assembly arrangement that is spring biased to apply an essentially constant tension in the drive transmitting pulley belt involved, which is free from overstressing, with the motor mounting assembly arrangement incuding a hand crank device for manually overcoming such biasing means in freeing the pulley belt for changing of the treadmill driving speed.

Still other objects, uses, and advantages will be obvious or become apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 1:
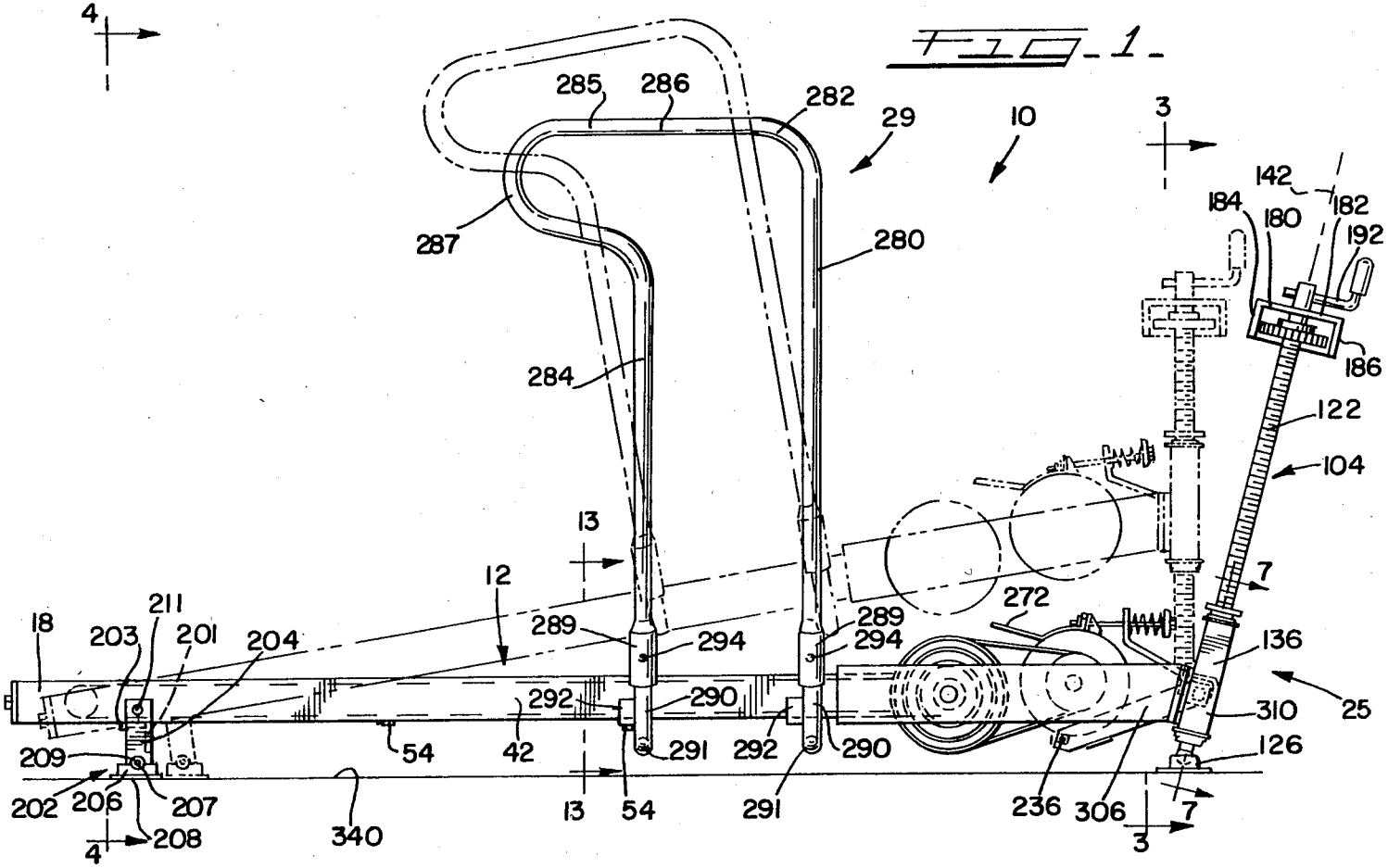
FIG. 1 is a side elevational view diagrammatically illustrating a preferred embodiment of the invention, showing the treadmill assembly in full lines and at zero slope position, and in phantom at its maximum slope position of the illustrated embodiment, which is 15 degrees relative to the horizontal or a 25 percent grade.
Figures 2, 8, 9:
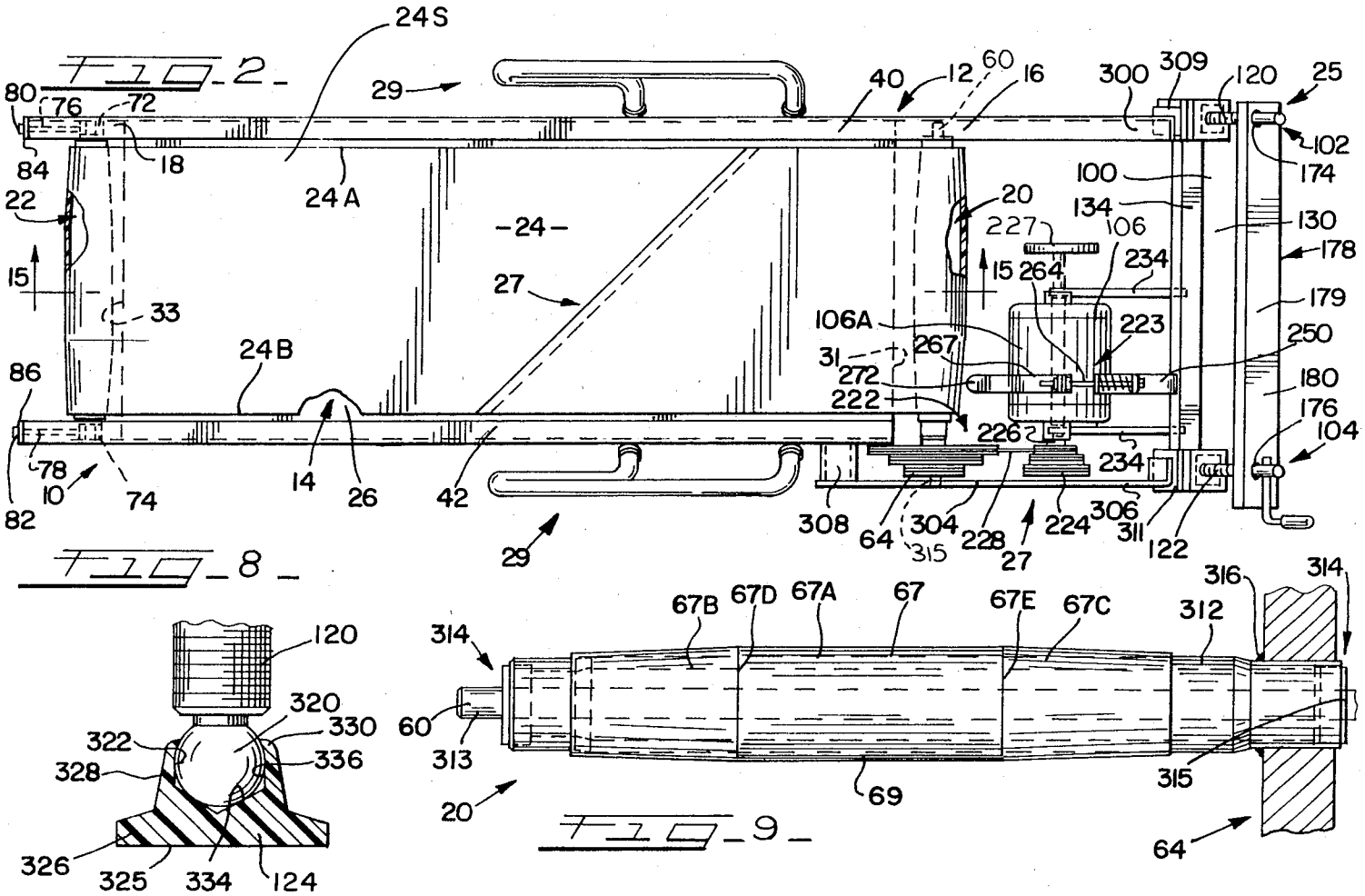
FIG. 2 is a top plan view of the treadmill assembly as shown in its full line position of FIG. 1, with parts broken away.
FIG. 8 is a fragmental sectional view of the lower end of one of the treadmill slider bed supporting screw members, illustrating its supporting foot in the manner in which the screw member is journalled in same.
FIG. 9 is a fragmental plan view of the treadmill head roller and its associated drive pulley, with parts broken away.
Figure 3:
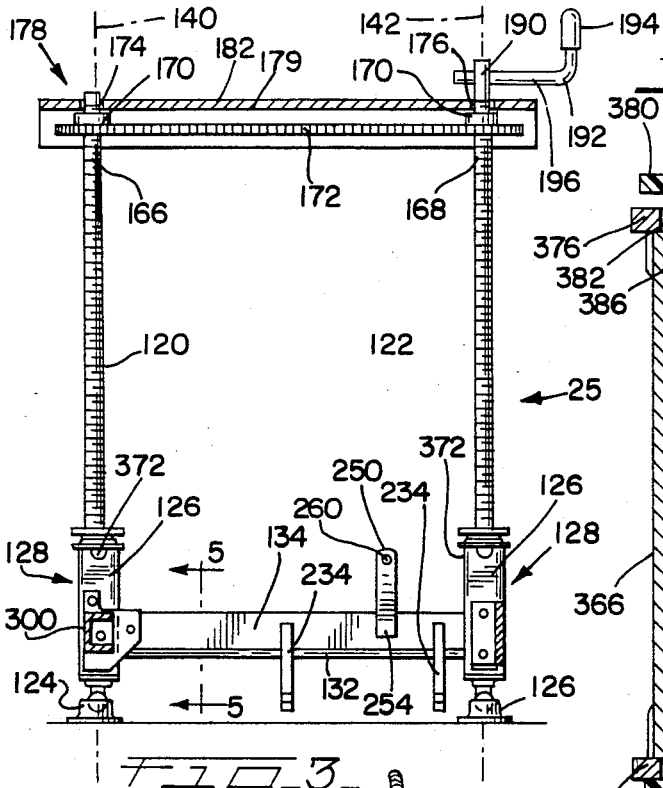
FIG. 3 is a vertical sectional view taken substantially along line 3—3 of FIG. 1, but with the operating motor assembly omitted to simplify the drawings.

Reference numeral 10 of FIGS. 1 and 2 generally indicates a diagrammatically illustrated embodiment of the invention that in general is similar to that disclosed in my said U.S. Pat. No. 4,374,587. For completeness of disclosure and for facilitating a full understanding of same, the general arrangement of the treadmill assembly or unit 10 of my said U.S. Pat. No. 4,374,587 is repeated herein, but as modified with or by the improvements of the present invention.

Figures 15, 16:
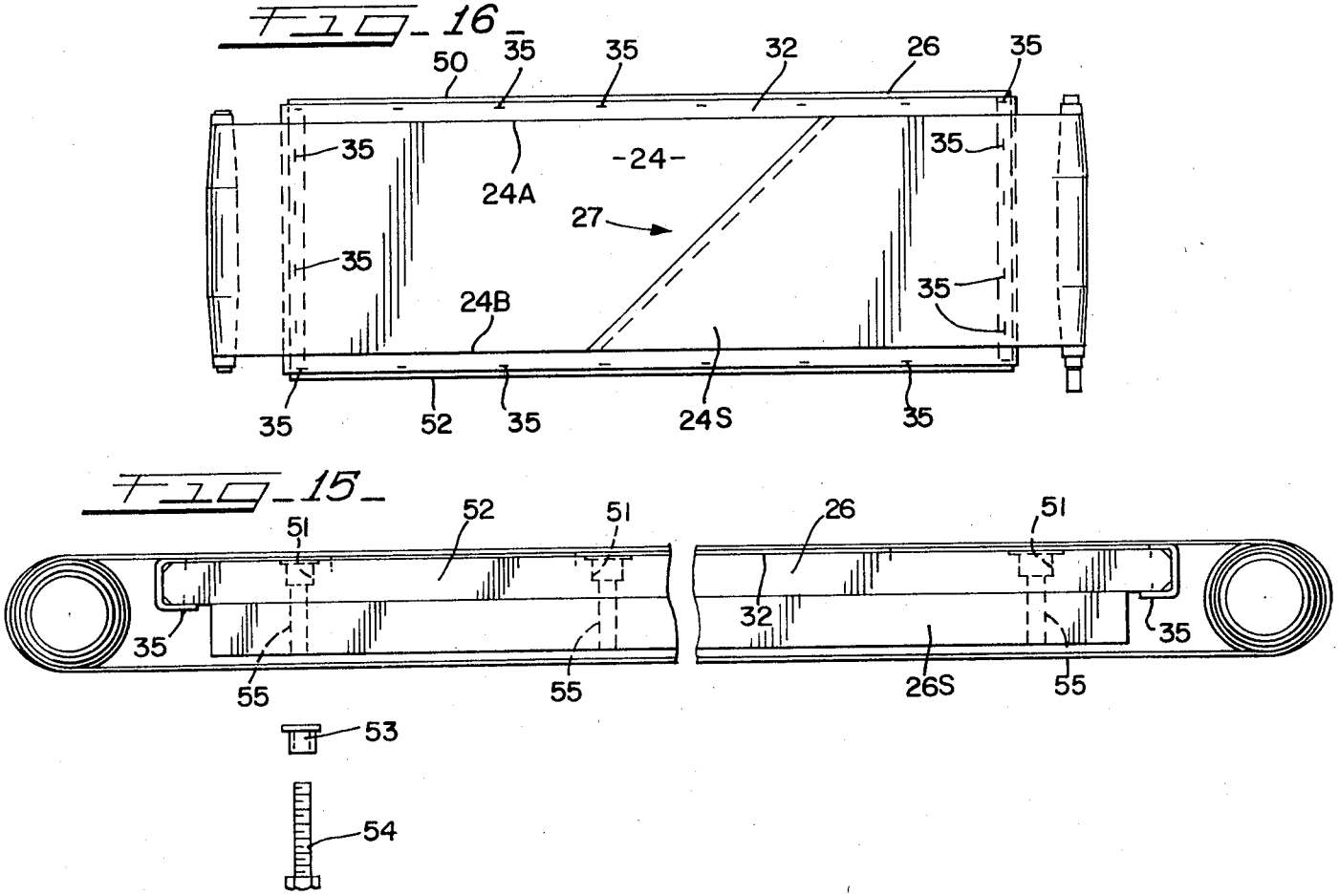
FIG. 15 is a side elevational view of the treadmill slider bed and belt trained over same, on an enlarged scale, and with parts broken away.
FIG. 16 is a top plan view of the slider bed and belt shown in FIG. 15.
Figure 18:
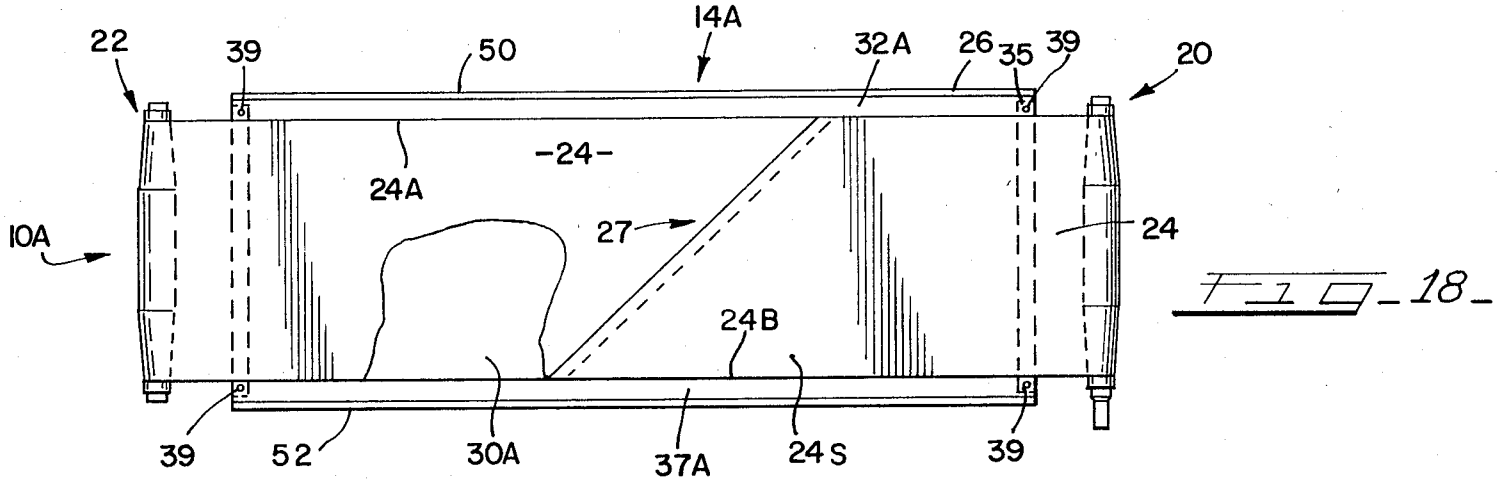
FIG. 18 is a view similar to that of FIG. 16, but illustrating the embodiment of FIG. 17, with parts being broken away.
Figure 17:
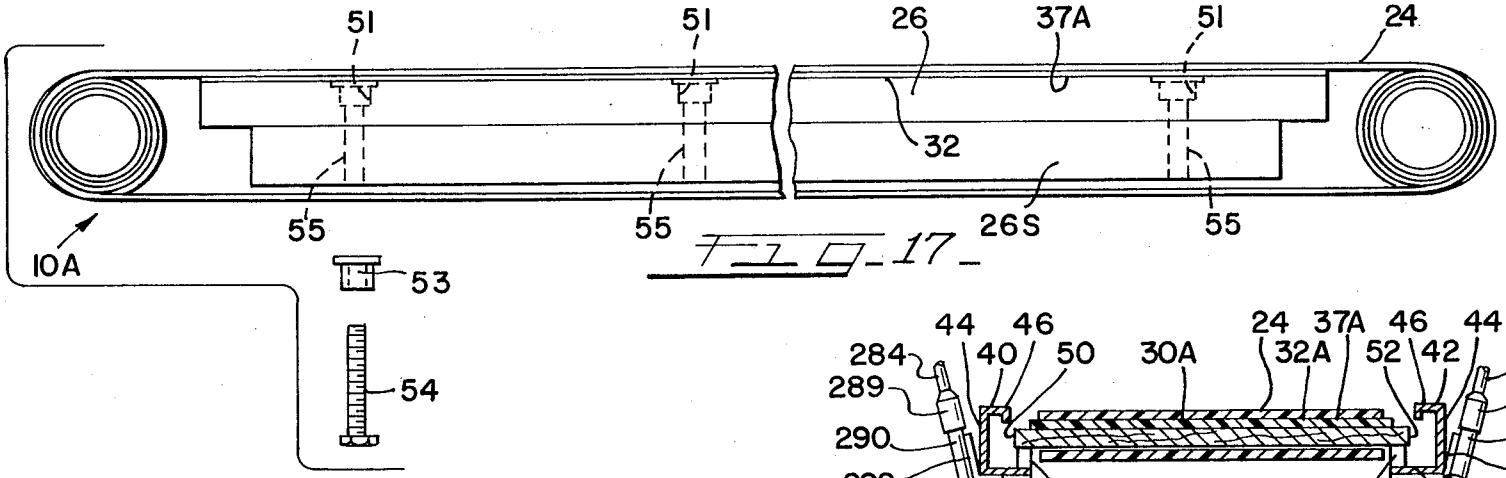
FIG. 17 is a view similar to that of FIG. 15, but illustrating a modified form of the invention.
Figure 19:
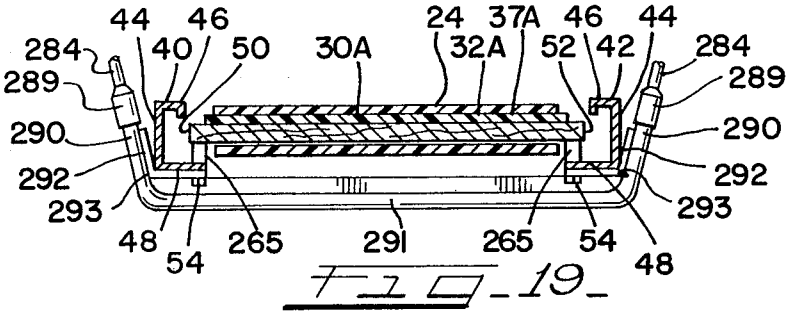
FIG. 19 is a view similar to that of FIG. 13, but illustrating the embodiment of FIGS. 17 and 18.

FIGS. 1–16 are concerned with one embodiment of the unit or assembly 10 arranged in accordance with the present invention, while FIGS. 17–19 illustrate a modified treadmill unit or assembly 10A.

The treadmill assembly or unit 10, which may also be termed a treadmill apparatus, generally comprises a flat or planar frame or deck 12 including a slider bed 14 extending between the forward or head end 16 of the frame or deck, and the tail or rear end 18 of same, a belt driving head, belt bend, roller 20 that is journalled at the head or front end 16 of the frame, an idler or tail, belt bend, roller 22 that is journalled at the rear or back end 18 of the frame 12, and an endless flexible belt 24 that is trained over the frame head driving and tail idler rollers 20 and 22, respectively, and extends across the slider bed 14. The treadmill frame or deck is equipped forward of the belt driving head roller 20 with a slope adjusting device 25, whereby the treadmill user may manually adjust the slope of the treadmill assembly between the two positions indicated in FIG. 1, with the frame or deck 12 also carrying the belt drive apparatus 27. The frame or deck 12 further is equipped with side mounted hand holds 29 disposed on either side of, and intermediate the ends of the treadmill endless belt 24 (see FIGS. 1, 2 and 4). Drive roller 20 is driven by motor 106 through pulley belt 28 and drive pulley 64.

The slider bed 14 of treadmill 10 comprises a flat or one piece base sheet of plywood or the like 26 (see FIGS. 4, 6, 13 and 16) of rectangular outline, and proportioned to extend substantially between the locations of the head roller 20 and the tail roller 22, with the slider bed sheet 26 being proportioned such that the slider bed ends are disposed where indicated in FIG. 2 at 31 and 33. The slider bed 14 has an upwardly facing surfacing 30 provided, in the embodiment of FIGS. 1–16, by a plastic sheet 32, of film thickness dimensions and formed from one of the materials hereinafter disclosed, suitably affixed to sheet 26, as by being anchored thereto using staples or the like where indicated at 35 in FIGS. 15 and 16. The surfacing 30 and sheet 32 should be dry and free of any lubricant materials of either the wet or the dry types during assembly as well as during use.

In accordance with the present invention, the treadmill belt 24 of the assembly or unit 10 is formed from an extruded plastic material of film thickness proportions that is characterized by being of low long term creep or stretch characteristics, when under the tension needed to keep the belt in slip free tight training relation with its rollers, while providing in association with the slider bed surfacing 30 and the belt driving head roller the minimized coefficient of dynamic friction characteristics with regard to the slider bed and maximized coefficient of static friction characteristics relative to the belt driving roller that are contemplated by the present invention that, together with the low tensioning of the belt that is required to provide the slip free tightness training of the belt with respect to its rollers that is contemplated by the invention, minimize the stress loadings on the bearings in which the belt rollers 20 and 22 are journalled, and minimize driving energy requirements for exercise use, which hold the horsepower driving requirements for treadmill 10 to well below one horsepower for walking exercise by a person having a weight of up to about 200 pounds.

Specifically, the Applicant's invention contemplates that stresses acting on the treadmill roller supporting bearings may be so minimized, and the driving energy requirements for the treadmill belt may be so minimized, by providing a treadmill belt of low long term creep characteristics, by providing for the coefficient of static friction between the belting and its drive roller to be a minimum of about 0.4, by providing for the coefficient of sliding or dynamic friction between the belting and the slider bed surfacing (which support the user during his exercise) to be no more than about 0.22, and by providing for a low tension slip free tightness training of the belt with reference to its training bend rollers, the roller supporting bearings not only may be of small or miniaturized area engagementwise for resisting stress, and or simplified construction for minimizing the size of the bearings, but also the treadmill may be run for walking exercise for an exerciser of about 200 pounds using a standard electric off the shelf motor of less than 1 horsepower, and for the useful life of the treadmill.

In line with these objectives of the invention, the belt 24 is formed from oriented (or prestretched) polyester film, or oriented nylon film, with the belting film forming material preferably being made by extrusion from the materials indicated to define extruded one piece sheeting 24S that is of homogeneous consistency and substantially uniform thickness across the width and length of same. These materials have both been found by the Applicant to have the low long term creep or stretch resistant characteristics that are important aspects of the present invention, and that are also important in the provision of the aforementioned coefficients of friction. In this connection the term "creep" is a term of art referring to the tendency of trained belting to permanently stretch under the tension acting on the belt for training and drive transmitting purposes, and in use, requiring repeated adjustment of the training apparatus involved to maintain the trained belting under the tension that is required for efficient operation of the belt in question, depending on the nature of the equipment in which it is involved and the purposes for which such equipment is to be used. When the range of belt adjustment that is provided in a particular endless belting arrangement to compensate for creep is used up, the creep problem can no longer be compensated for, as may be needed for proper training of the belt about its driving and bend pulleys, without shortening the belt, or providing for deflected take up of same (as is commonly found in belt conveyor equipment for handling bulk goods, for instance).

In accordance with the present invention, the treadmill belt 24 is preferably formed from bilaterally oriented or prestretched polyester film having thickness that lies in the range of from about 0.010 inch to about 0.030 inch, with the thickness preferably being at the low end of the indicated thickness range. One commercially available film of this specification is MYLAR polyesther film offered by DuPont (E. I. DuPont de Nemours & Co., Wilmington, Delaware) which is made from the polymer polyethylene terephthalate; ICI Americas Inc. (of Wilmington, Delaware) offers the same film commercially under the trademark MILENEX. The polyesther film in question is a dimensionally stable, moisture resistant, relatively stiff, long wearing product that is characterized by low long term creep or stretch resistance under tension, a high tensile strength of 25,000 psi, and since it contains no plasticizers, it does not become brittle with age. It is also ultrasonic weldable to itself, which is important in forming endless belt 24 by securement together of the ends of the film sheeting that is selected to form the belt 24.

The low long term creep or stretch resistance characteristics that the invention contemplates for the belt 24 to have, for the practice of the invention in its best mode, are that under the invention minimized belt training tension requirements, the belt, as trained, and in normal useful life use, is to permanently stretch longitudinally of same no more than about 2 percent of, its length under the slip free tight tensioning that is contemplated by the present invention for training of the belt about its rollers, and yet be of the extrusion formed, homogeneous sheet type, of film thickness proportions, with the sheet being of an initial length suitable for fashioning into a treadmill belt and trained for this purpose in the manner indicated hereinafter for exercise treadmill use.

Exercise treadmill use typically contemplates a treadmill of the endless belt type having a length in the range of from about 3 to 4 feet to about 10 feet, for exercise walking and trotting treadmill use.

In a commercial walking exercise embodiment of the invention, the film sheet of film thickness proportions used to form the belt is 93.75 inches long for forming the moving treadmill component of a treadmill frame 12, and while the effective length of the treadmill defined by the particular belt employed to form the moving treadmill component of a treadmill assembly is optional, the indicated low long term creep or stretch resistance of the belt has been found to be one of the critical considerations in the practice of the invention, and forms an important criteria or parameter for exercise treadmills having the characteristics indicated.

Oriented or prestretched nylon is also satisfactory for forming belt 24 for the practice of the invention where the belting is not subject to significant humidity changes in the air ambient to same. This product is available from Moldex, Inc., Putnam, Conn., or Nitta International Corp., Norcross, Ga., and should be in sheeting form of film thickness dimensions having its thickness in the indicated 0.010 to 0.030 inch range. The oriented nylon product supplied by Moldex is formed using American Hoechst nylon 446 resin.

Nylon, or polmeric amide sheeting that is oriented or prestretched, differs from ordinary nylon extruded sheeting in that the sheeting involved is initially extruded to a thicker dimension than the finalized sheeting is to have, with the resulting sheeting substantially being prestretched to the desired thickness under close controls of temperature and other factors by being applied over a suitable bend roller arrangement. While oriented nylon has less resistance to bending than MYLAR polyester film, it has the low long term creep or resistance to stretch as such, that the Applicant has found to be critical. However, it has also been found that the moisture absorption characteristics of nylon tend to act like a temperature coefficient in that exposure of the nylon belting to excessive humidity will result in increased length that is lost or disappears when excessive humidity of the ambient air is dissipated or dispersed. Thus, oriented nylon has been found to have the requisite low long term low creep characteristics that the invention contemplates but exposure of such belting to high humidity can temporarily adversely effect the tension in the belt as trained until the excess humidity condition is removed.

In this connection, the Applicant has found that plain or non-oriented nylon film and sheeting have long term creep or stretch characteristics that are too great for the practice of this invention, with the result that these materials when used to provide a belt 24 stretch under tension in use so excessively that the static friction coefficients that the Applicant has found to be critical to the practice of the invention, with regard to the application of the treadmill drive roller to the treadmill belting, cannot be maintained to any realistic degree, due, for one thing, to the impracticality of providing in a treadmill for the large amount of belt effecting adjustment needed to compensate for for the stretch or creep in the belt, so as to maintain the belt in reasonable driving relation with its drive roller. Further, the tendency of ordinary nylon film and sheeting to absorb moisture has been found to accentuate their lack of good long term creep characteristics, as treadmill belting formed from same tends to lengthen all too rapidly under tension due to the absorption of ambient moisture.

The sheeting 24S in the form of one of the long term creep or stretch resistant materials indicated, is shaped to define the belt 24 by having its ends overlapped and fixed together, as by employing ultrasonic welding, or by employing a suitable adhesive, where indicated at 27 in FIGS. 2 and 16, or bonding using heat and pressure, for using suitable mechanical fasteners of a low profile nature. Alternately, the belt 24 may be formed in one piece looped form, shaped by suitable processing, from one of the materials indicated, to have the long term low creep or stretch characteristics contemplated by the present invention.

It has been found that the indicated thickness of the belt 24 lying in the range of from about 0.010 inch to about 0.030 inch is desirable for training application of the belt to treadmill rollers 20 and 22 having maximum diameters (including the hereindescribed grounding) in the range of from about 1.5 to about 2.0 inches (both rollers 20 and 22 have the same maximum diameter of 1.660 inch, and the belt thickness being 0.014 inch, in a successful embodiment, employing the aforementioned MYLAR polyester film to make the belt 24).

Further in accordance with the invention, in the treadmill 10, the sheet 32 of the bed or deck 14 is a length of either of the aforementioned polyester film sheeting or the oriented nylon sheeting, with the belting 24 being formed from one of the low long term creep resistant materials indicated. The sheet 32 formed from one of these materials preferably has a thickness that lies in the range of from about 0.005 inch to about 0.015 inch, the sheet 32 thus being relatively thin as compared to the thickness of the sheet 24S that forms the belting 24 for material economy purposes; for instance, the sheet 32 may be 0.007 in thickness, and thus one half the thickness of the belt 24, in the embodiment of the invention that is mentioned immediately above.

As pointed out, the plastic sheetings for forming the treadmill belt 24 and slider bed sheet 32 are preferably formed from the indicated extruded plastic film sheeting materials (polyester film or oriented nylon film) for minimizing long term permanent creep or stretch of same in use; in addition, they provide improved heat dissipation, and foreign matter adherence resistance (and thus are easier to keep clean). The polyester film material specified has the additional advantages of being relative inexpensive (such as $2.70 per pound for the 0.014 inch thick film), and readily available commercially in any desired width and quantity in roll or sheet form. Both materials are resistant to wear, and maintain their relatively high tensile strength in temperature extremes. The polyester film material is fully moisture resistant and the oriented nylon is adequately so for purposes of the present invention, but since oriented nylon has a greater long term creep (and thus less resistance to stretch, than the indicated polyesther film material, under tension), oriented nylon does have moisture absorption problems which can contribute to creep of same, and oriented nylon is relatively expensive to obtain on the market, it is considered a less satisfactory material for forming the belt 24.

The Applicant's studies of the performance of treadmill assemblies 10, using as his belt 24 and sheet 32 one of the low long term creep or stretch materials indicated, with the slider bed surfacing 30 being free of any dry or wet lubricants, indicate that such assemblies not only provide a slider bed type treadmill arrangement that has better antifriction characteristics than if the surfacing 30 were formed with canvas or the like impregnated with such substances as wax or graphite, but that the coefficient of dynamic or sliding friction of the belt 24 on the sheet 32, and in particular on its surfacing 30, can be no more than about 0.22, in combination with the hereinafter described coefficient of static friction criteria provided at the treadmill driving roller, and the slip free tight but nominal tensioning of the belt for training purposes, to achieve the minimized drive energy requirements and minimized head and tail roller bearing stress resisting requirements, that are major objectives of the present invention, and that permit the driving of the treadmill to be effected with less than 1 horsepower capability. This will be more fully explained as the disclosure proceeds.

In the treadmill assmembly or unit 10A of FIGS. 17—19, the sheeting 32A is in the form of a hardboard panel or length 37A that is applied to the top of a sheet 26 in overlying substantially coextensive relation, with the sheet 26. The panel or sheet 37A should be hardboard of the type formed from steam exploded wood chip compressed fiber material, such as the hardboard product sold under the trademark MASONITE by Masonite Corporation of Chicago, Ill. for results that are in accordance with the present invention. This hardboard product is manufactured by the so-called wet process method pursuant to which chips or wood are placed in autoclaves and subjected to steam of pressures of 1,000 psi for a brief period, which on release of the steam explodes the chips which are then recombined under pressure to form the hardboard product sold under that trademark.

The panel sheet 37A is secured in place by suitable screw fasteners 39 where indicated at the four corners of the sheet 26, with the smooth or planar side of same facing upwardly to form the slider bed surfacing 30A, and the rough and normally underside of the hardboard facing downwardly. As indicated in FIG. 19, the component parts of the treadmill assembly 10A are arranged for ready replacement of the panel or sheet 37A by releasing the tensioning of the belt 24, removing the screws 39, and a hand hold 29 on one side of the treadmill, slipping the used sheet 37A out from between the belt 24 and the slider bed sheet 26 from such side, and then replacing the new panel or sheet 37A in the same position as the replaced sheet 37A, and reapplying the removed handle 29 and the fasteners 39 in the reassembly of the treadmill.

The belt 24 of the assembly or unit 10A is preferably formed from one of the aforementioned low long term creep or stretch resistant materials, namely the indicated polyester film material or the indicated oriented nylon film material. The treadmill operation of the belt on the sheet 37A has been found to meet the Applicant's objectives of the invention with regard to the indicated desired coefficient of dynamic or sliding friction, of the belt riding on the sheeting 32A, and specifically its surfacing 30A; the training of the belt 34 relative to the treadmill head and tail rollers, the tensioning of the belt against the treadmill head and tail rollers, and the desired coefficient of static friction relative to the driving head roller, are the same as for the treadmill 10.

Operating experience with the hardboard sheeting 32A has indicated that the surfacing 30A it provides may tend to wear away to a roughened surface of increasingly unsatisfactory frictional characteristics that eventually could cause stalling of the low horsepower motor drive intended for the apparatus 10A. This problem has been overcome in practice by brush or spray applying silicone oil, diluted in a suitable solvent, to the hardboard planar surface defining the surfacing 30A, prior to the application of the hardboard to the slider bed (3 parts solid to 1 part silicone oil is preferred). The silicone oil as so applied to the hardboard planar surfacing penetrates the hardboard surfacing involved and becomes unitary therewith, so as to continue the low dynamic of friction characteristics contemplated by the present invention.

Should the panel or sheet 37A require replacing, the replacement is facilitated by the relatively simple manner in which the sheet 37A is applied to the slider bed, as by using only the four fasteners 39 at the four corners of the slider bed, whereby the sheet 37A may be readily replaced in the manner indicated when the treadmill is not operating.

The treadmill frame 12 for both slider beds 14 and 14A further comprises a pair of opposed channel members 40 and 42, each of which comprises a web portion 44 and spaced flanges 46 and 48. Slider bed 14 is formed to define longitudinally extending side edges 50 and 52 over which the respective frame members 40 and 42 are applied, with the suitable bolts or screws 54 anchoring the slider bed (as equipped with the surfacing 30 or 30A) to the frame members 40 and 42 at spaced points along the treadmill frame 12. In the form shown, wooden sheet 26 has spacers 26S formed from wood stripping or the like, applied in underlying relation to the sheet 26, and the sheet 26 is recessed at 51 to receive "T" nuts 53, and is formed to define bores 55, to receive the bolts or screws 54 that secure these parts together (see FIGS. 1, 4, 13 and 15).

In the form of the invention shown in FIGS. 17–19, the outwardly directed side edges of the panel or sheet 37A may extend somewhat short of the respective side edges 50 and 52 of the slider bed so as to be disposed for ready finger grasping by the individual removing and reapplying the sheet 37A in place, free of interference from the upper flanges 46 of the frame channel members 40 and 42.

The end 300 of the frame member 40 extends forwardly of the apparatus for association with slope adjusting device 25, and the frame member 42 is equipped with mounting plate 304 for the same purpose, plate 304 being suitably secured to frame member 42 by employing a fabricated connecting block 308 that is welded or otherwise secured to the plate 304 and channel member 42 at its web portion 44.

The head roller 20 comprises (see FIG. 9) roller shell 312 journalled on shaft 60 by suitable ball bearing units 314 (of a commercially available form) at either end of same. Shaft 60 is suitably secured or anchored in channel member 40 at one of its ends 313 and the plate 304 at its other end 315, with suitable step drive pulley 64 being received over one end of the shell 312 and welded thereto as indicated at 316 (see FIG. 9) or otherwise suitably keyed thereto.

The roller shell 312, which is conveniently formed from steel or the like, is provided with a coated crown 67 that is preferably defined by suitably machining shell 312 to the shape indicated, and coating the resulting shell surfacing with urethane rubber, as by spraying or painting same in uniform thickness thereabout, with the thickness lying in the range of from about 0.005 inch to about 0.015 inch, to form a roller crown surfacing 69 along the length of the roller shell 12 of uniform film thickness dimensions. The resulting urethane rubber coating should be of substantially uniform thickness about the shell 312, which thickness should be of the indicated film dimensions, as, for instance, 0.010 inch, and the coating should have a durometer of approximately 50. A preferred material for forming crown surfacing 69 is the pourable urethane rubber product offered commercially by Devcon Corporation of Danvers, Massachusetts as its brand FLEXANE 80 urethane rubber, which is in kit form; in the kit in question there is included the urethane rubber resin, a suitable hardener, and an additive to limit the hardness of the resulting coating. The liquids involved are suitably mixed to provide, as cured, a coating hardness of about 50, and the roller shells 312 are spray or paint coated while rotated about their respective axes, to insure application of the coating to a uniform depth or thickness thereabout, after which the coated shells are suitably baked while rotating about their respective axes to bond the roller coating to the shell.

The crown 67 of the drive roller 20 is provided for belt centering purposes, and the crown coating surfacing 69, in accordance with the present invention, provides the increased coefficient of static friction of the drive roller crown surface 69 relative to the belt undersurface that it engages that is called for by the present invention, as compared to the significantly less coefficient of static friction that would be provided if the uncoated shell 312 were in driving relation to the undersurfacing of the belt 24. The driving roller crown 67 has a length that approximates the width of the belt 24, and the driving roller crown coating defines crown surfacing 69 that is of the special shaping shown in FIG. 9 for centering the treadmill belt 24 relative to the treadmill slider bed. crown 67 thus defines a cylindrical contoured center or mid portion 67A that at length approximates one half the width of the belt 24, and frusto-conical end portion 67B, 67C that have their larger ends merging with mid portion 67A at merge line 67D and 67E. End portions 67B and 67C each have a length that approximates one quarter of the width of the belt 24. The crown surfacing 69 thus has the same shaping as crown 67.

The treadmill tail roller 22 is arranged in the same manner as the driving head roller 20 (see FIG. 14), except for its crown surfacing forming coating, and thus roller 22 comprises roller shell 312A journalled on shaft 70 by suitable ball bearing units 314A (which are commercially available) at either end of same. The shaft 70 has its opposite ends received in the respective support plates 72 and 74 (see FIG. 2) that are suitably slidably mounted within the respective frame members 40 and 42, with such ends of the shaft 70 being suitably threadedly connected to the respective bolts 76 and 78 that have their respective heads 80 and 82 seated against the respective abutment plates 84 and 86 that are suitably fixed to the ends of the respective frame members 40 and 42 at the tail or rear end of the frame 12, to provide for both spacing and angulation movement of the tail roller 22 relative to the head roller 20, to tension the belt for proper roller training and driving purposes, and maintaining same centered on the rollers 20 and 22 during operation of the treadmill assemblies 10 and 10A. The adjustment range or distance provided for the tail roller 22 toward and away from the head roller 20 is approximately 1 inch in the plane of the treadmill bed 14, which permits the treadmill belting to be adjusted to accommodate 1 inch stretch in each run of the belt 24 (the upper and lower runs thereof), for total stretch in the belt of approximately 2 inches.

The treadmill tail roller shell 312A has formed on same the crown 85 that may be formed in the same manner as crown 67. Thus, the shell 312A is suitably machined to provide the indicated shaping of the crown 85; further, the resulting shell surface may be coated in the same manner as a driving roller crown 67, but since the tail roller is not a belt driving roller such coating may be omitted. In either event the crown 85 of the tail roller 22 defines the cylindrical contoured centered or mid portion 85A that in length approximates one half the width of the belt 24, and frusto-conical end portions 85B and 85C that have their larger ends merging with the portion 85A at merge lines 85D and 85E. Head portions 85B and 85C each have a length that approximates one quarter of the width of the belt 24. For the tail roller 22, the crown 85 is centered thereon. In the preferred embodiment the crown portions 67A and 85A have a diameter of 1.66 inches and the crown frustoconical portions 67B 67C, 85B and 85C taper to 1.625 inches at their opposed ends.

In the case of the tail roller 22, while it is not necessary to provide the elastomeric coating or covering for the roller crown 85 since it is not a belt driving roller, nevertheless application of such coating to the tail roller crown is preferred, to provide the surfacing 87 thereof, which coating is really for the purpose of providing a corrosion resisting, rust preventing crown surfacing of long wearing characteristics. The coating involved may be the same as that employed on the head or driving roller 20, but in practice it is satisfactory to form the coating from nylon or other suitable coating materials that is provided by way of a suitable electrostatic powder spraying process for application to the roller, with the coating being preferably omitted about a narrow cylindrical mid portion of the tail roller at the center of its mid portion 85A, where indicated in dashed lines at 89, so as to leave a band like portion of the metallic shell 312A at this point exposed for electrical grounding engagement with the belt when the belt 24 is in tensioned, training relation with the tail roller 22. This thus has the crown surfacing 87A in two separate portions, on either side of the tail roller 22; the roller metal surfacing in between may be optionally plated as needed to insure good electrical contact with the belting when the treadmill is assembled. After coating as indicated, the roller is heated to fuse the nylon to the metal involved.

In the assembly of a frame 12, and in particular the application of the belt 24 to the slider bed 14, and rollers 20 and 22, the tail roller mounting plates 72 and 74 (that mount the roller 22 by way of the opposite ends of its shaft 70 being received in the respective plates 72 and 74) are positioned relative to drive roller 20, after the treadmill is assembled, by appropriate rotation of the bolts 76 and 78 that are respectively in screw threaded relation with the respective plates 72 and 74, to tension the belt 24 in slip free tightness relation against the relation rollers 20 and 22. For belts formed by the aforementioned polyester film, this involves stretching the belt 24 about $\frac{1}{8}$th inch at its central or mid portion that engages the roller ground portion 67A and 85A, with the belt side edges 24A and 24B having full contact with the respective frusto-conical ground portions 67B, 67C, 85B, and 85C of the respective rollers 20 and 22. Such side edge contact of the belt with the crown surfacing of the rollers, in addition to the center ground surfacing corresponding to ground portion 67A and 85A is essential to have full tracking of the belt 24 on its training rollers 20 and 22. For oriented nylon, the stretch required is about or approximately $\frac{3}{8}$ths of an inch with the same result.

The treadmill assembly 10 or 10A is started, and the adjustment bolts 76 and 78 are again adjusted to position the tail roller 22 relative to the drive roller 20, so that the belt 24 tracks correctly lengthwise and sidewise of the treadmill when the belt is moving. This sets the treadmill belt with the belt 24 in the desired slip free tightness trained relation relative to its rollers 20 and 22;

the belt in this relation will typically be tensioned to provide a pull force acting to bias rollers 20 and 22 toward each other in the range of from about 100 to about 250 pounds. When the treadmill assembly 10 or 10A is used for exercising purposes, the user may need to initially adjust again the bolts 76 and 78 so that the belt will not slip with respect to the rollers 20 and 22 if his weight significantly exceeds about 200 pounds.

It is a feature of the invention that the materials from which the belt is formed permit the belt to be applied against its training rollers in slip free tight relation thereto for driving purposes with a tension that is nominal compared to the tensile strength of the material forming the belting. In accordance with the invention, the desired slip free but tight roller engagement by the belt, at the respective rollers 20 and 22 is provided by tensioning and re-tensioning the belt 24 as needed due to creep the belt 24, using adjustment bolts 76 and 78, to keep the belt tension at what will provide the indicated slip free relation of the belt to its training rollers, which typically will fall in the indicated pull force range. The amount of belt tensioning pull force required to achieve the slip free but tight roller engagement of the belt with respect to its training rollers during exercise use will vary somewhat, depending on such independent factors as the weight of the user of the treadmill whether the exerciser is a light or heavy stepper and the ambient atmosphere conditions of the locale where the treadmill is to be used; another factor that will be involved is whether or not polyester film or oriented nylon is employed in making the belt. It is to be further noted that in the treadmill arrangement illustrated, and in treadmills in general, only two training rollers are involved at opposite ends of the moving way provided by the treadmill, and these are essentially oppositely disposed bend rollers to which the belt is applied essentially 180 degrees thereabout whereby the tension stress in the belting upper and lower runs is essentially in the plane of the treadmill and thus frame 12.

The crowns 67 and 85 may also be defined by appropriately shaped nitrile rubber tubes (preferably wax free so as to be free of "blooming" in use) suitably applied to the respective shelves 312 and 312A. Crowns 67 and 85 may also be formed by molded in place urethane, polyurethane, or other suitable elasomers. In both of these instances, the crowns 67 and 85 are appropriately shaped to define the respective crown surfacings 69 and 87 of the configurations indicated.

As has been indicated hereinbefore, a critical aspect of the invention is the Applicant's discovery that the loads on the bearings 314 and 314A in which the treadmill rollers 20 and 22 are journalled may be minimized, and thus the driving horsepower requirements may be minimized, when using belting formed from the aforementioned polyester film or oriented nylon film, riding on a slider bed surfacing defined by one of the said materials hereinbefore specified for forming the sheets 32 or 32A (as described hereinbefore) and by using as the belt driving roller crown surfacing a suitable elastomer, while retaining the basic metallic roller structure for strength and rigidity, and keeping the belt tensioning forces within the low stress range indicated, and by providing for the static coefficient of friction of the belting relative to the elastomeric crown surfacing defining material to be a minimum of about 0.4, and further providing for the coefficient of dynamic friction or sliding friction of the belt 24 riding on the slider bed surfacing 30 to be no more than about 0.22 (with such coefficient of dynamic friction preferably being about 0.15 and being obtained using the bilaterally oriented polyester film and oriented nylon belting materials that have been indicated).

As to the indicated static coefficient of friction parameter, tests have shown that, for instance, the painted or sprayed on preferred urethane rubber coating material (50 durometer) relative to the indicated polyester and oriented nylon rilms has a static coefficient of friction of about 0.5, nitrile rubber (50 durometer) relative to oriented nylon has a static coefficient of friction of about 1.36, neoprene 65 durometer) has a corresponding coefficient of friction of about 1.31, SBR butadiene (65 durometer) has a corresponding coefficient of friction of about 0.89, and gum rubber (35 durometer) has a corresponding coefficient of friction of about 0.37; these and other equivalent elastomers thus provide the indicated minimum coefficient of static friction that satisfies the invention requirements for use as the drive roller crown surfacing. However, the indicated urethane rubber material, for spraying or painting application to the head roller, is preferred because of its ease of application and ready assumption of uniform depth of film proportions by being printed or sprayed on the rollers as the rollers are rotated. The same coating may also be applied to the tail roller as indicated, with suitable provision being made for contact of the metallic portion of the tail roller with the belting for static electricity grounding purposes (as mentioned hereinbefore).

As to the coefficient of sliding or dynamic friction parameter that is specified, this is concerned with minimizing the drag on the treadmill belting when the person using same is doing walking exercise. By observing this criteria, together with the other parameters indicated, belt slippage at the rollers is avoided, when the user's weight is foot rested on the treadmill moving way during walking, for users of up to about 200 pounds in weight.

The result is that the Applicant's treadmill combination as represented by the hereindisclosed assemblies units 10 or 10A provides for the bearings for the belt training rollers 20 and 22 to be of relatively reduced or small stress resisting area needs, and thus they can be greatly simplied and of inexpensive, off the shelf, commercially available design, by reason of the substantial minimization of the bearing stress requirements involved, and driving energy requirements for driving the treadmill way are correspondingly minimized, making it possible to drive the treadmill belt with a fractional horsepower electrical motor of any suitable standard make, an off the shelf one third horsepower motor being employed in a commercial embodiment of the invention, in which the moving exercise way or path defined by the treadmill belt is approximately four feet long, and for walking exercise for users of a weight up to approximately 200 pounds.

The invention thus contemplates that the low long term creep type treadmill belt 24, and at least the drive roller 20 (and specifically its crown surfacing 69) should have a minimum coefficient of static friction of about 0.4, while the belt 24 along the slider bed surface 30 should have a maximum coefficient of dynamic or sliding friction that is about 0.22, in association with the low tension slip free tight application of the belt to the belt training rollers 20 and 22 that is contemplated by the invention for achieving the treadmill simplification and treadmill way drive efficiencies of the invention.

Where the belting 24 has the low long term creep or stretch characteristics contemplated by the invention, the positioning of the tail roller 22 relative to the drive roller 20 may periodically require changing to maintain the slip free tightness of the belt on the rollers 20 and 22 that is contemplated by the invention, without unduly tensioning the belt and overloading the bearings of the rollers 20 and 22, so that the minimized drive energy requirements contemplated by the present invention would not be applicable (resulting in stalling of the drive motor). The range of adjustment provided for taking up the belt creep in accordance with the invention, at the bolts 76 and 78, is adequate for the useful life of the equipment where the indicated low long term creep belting material is employed; the useful life in question is considered to be approximately two years, assuming daily or substantially daily exercise use with the belt being tensioned for the indicated slip free tightness relationship against the treadmill rollers in the tensioning psi range that has been indicated.

SPECIFIC DESCRIPTION

The disclosure that follows is with reference to treadmill 10, but the arrangement involved is applicable to both treadmills 10 and 10A.

Frame 12 at its head end 16 includes a pair of slope adjusting support devices 102 and 104 that comprise device 25 and cooperate with frame cross member 100. The drive motor 106 (and associated parts) for driving belt 24 comprising drive apparatus 27 are also mounted at the frame head end 16. As indicated hereinbefore, the arrangement of the treadmill assemblies 10 and 10A permits the use as motor 106 of a conventional electric motor of less than one horsepower for driving belt 24 for walking exercise for an exerciser of about 200 pounds; in a commercial embodiment of the invention the motor serving as motor 106 for these purposes is a one-third horsepower electric motor, that is of the sixty cycle A.C. split phase type offered by Marathon Electric Mfg. Corp., Wausau, Wis., or Emerson Electric Co., St. Louis, Mo.

The general arrangement of the frame cross member 100 and its slope adjusting support devices 102 and 104 is of special significance. As indicated in FIG. 1, and following the disclosure of my said U.S. Pat. No, 4,344,616, it is a feature of the invention that for zero slope conditions, the slope adjusting devices 102 and 104 are to be in their retracted positions, but when the treadmill is elevated to its maximum design height, the devices 102 and 104 are to be in their extended positions relative to the frame 12 for slope defining purposes. It is apparent that for the treadmill 10, when in its maximum slope defining positions, its stability needs for the head end 16 of the frame 12 are maximum, while in its zero slope defining position (the full line position of FIG. 1), its stability needs are minimal.

The invention contemplates that the treadmill assembly 10 will provide for a repositioning of the slope adjusting devices 102 and 104, which incidentally are the only means of support of the treadmill 10 at its forward end, so as to improve the stability they provide, as the treadmill position of maximum slope is approached and reached, in accordance with the increasing need for stabilization as the frame head end elevates. For this purpose, the Applicant's arrangement contemplates that the slope adjusting devices 102 and 104 will be disposed to operate about upright axes that are at an acute angle off perpendicular or normal relation with the plane of the slider bed 14, which acute angle is equal to the acute angle of the slider bed 14 relative to the horizontal that will provide the maximum slope of operation of the treadmill 10. Further, the slope adjusting devices 102 and 104 are to be of sufficient length to elevationally move cross member 100, and thus the treadmill frame 12 to the indicated slope maximum, while at the same time shifting the slope adjusting devices 102 and 104 from the forwardly angled relation, upwardly of the treadmill, that is illustrated in the full line showing of FIG. 1, to the substantially vertical relation that is illustrated in the phantom line position of FIG. 1, which disposes the slope adjusting members 102 and 104 for maximum bracing relation relative to the frame 12.

In the specific arrangement illustrated, this aspect of the invention is provided by way of slope adjusting devices 102 and 104 each comprising the respective screw or threaded members 120 and 122 that are respectively equipped with the respective front feet 124 and 126 in the manner diagrammatically illustrated in FIG. 8 for the foot 124. The threaded members 120 and 122 are each respectively threadedly mounted in cross member 100 by a stationary nut assembly 128 that is more particularly illustrated in FIGS. 7 and 11, and which will be described in detail hereinafter (see also my said U.S. Pat. No. 4,374,587).

Figure 5:
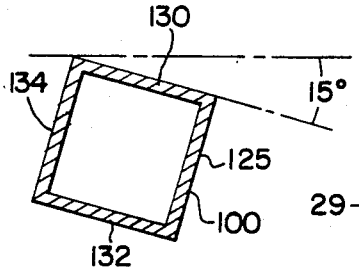
FIG. 5 is a fragmental sectional view taken along line 5—5 of FIG. 3, but shown on an enlarged scale.
Figure 6:
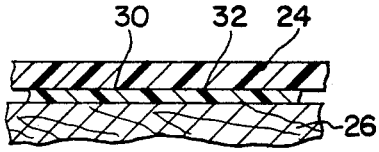
FIG. 6 is a fragmental sectional view on an enlarged scale illustrating a section through the belt and slider bed and showing the synthetic resin film sheeting that forms the slider bed top surfacing, of one embodiment of the invention, across which the upper run of the belt rides.

In the specific form illustrated, cross member 100 is of quadrilateral tubular transverse cross-sectional configuration (approximately square in the illustrated embodiment, see FIG. 5) and defines top wall 130, bottom wall 132, rear wall 134 and forward wall 135, as illustrated in FIG. 5.

The nut assemblies 128 each comprise in the illustrated form a tubular member or shell or sleeve 136 of quadrilateral transverse cross-sectional configuration (square in the illustrated embodiment) with shells 136 suitably fixed to either end of the cross member 100, as by employing welding, so as to be an integral part of the cross member 100. Each shell 136 has applied to either end of same nut elements 138 and 138A that are formed, for instance, from nylon or the molybdenum disulphide filled nylon product sold under the brand name Nylatron GS (by The Polymer Corporation, of Reading, Pa.), and keyed to the sleeve 136 in the manner described in detail hereinafter, and that are suitably internally threaded and oriented to complement the threading of the respective threaded members 120 and 122 for threaded relation thereto. Suitable roll formed threading of any suitable type may be employed for this purpose, as will be hereinafter made clear.

The sleeves 136 of nut assemblies 128 are fixed (as by welding) to the cross member 100 (and thus are a part of same) so that the axes of rotational operation 140 and 142 of the respective devices 102 and 104 will be perpendicular to the planes of top and bottom walls 130 and 132 of the cross member 100 and be centered between the planes of side walls 134 and 135 of same (as indicated by the showing of FIG. 1). However, the cross member 100 and the nut devices 128 affixed thereto at either end of same are secured into the frame 12 in angled relation thereto, as is also indicated in the showing of FIG. 1 as well as FIGS. 5 and 10. In this angled relationship, the cross member 100 and its associated nut devices 128 are oriented relative to the plane of the slider bed 14 and its frame 12 so that the top and bottom walls 130 and 132 of the cross member are angled at an acute angle relative to the plane of slider bed 14 and frame 12, with the result that the axes of rotational operation 140 and 142 of the respective slope adjusting devices 102 and 104 are angled at the same acute angle off the vertical when the frame 12 is horizontally disposed. In this position of the frame 12, the operational axes 140 and 142, in addition to lying in parallel vertical planes that extend longitudinally of the frame 12, also project forwardly of the unit 10 upwardly of the frame 12.

As has been indicated, the treadmill assembly 10 is arranged and proportioned to provide a maximum slope of approximately twenty-five percent in its position of maximum inclination, which translates into an angulation of approximately 15 degrees relative to the horizontal, as indicated in FIG. 1 (an angulation of 15 degrees by tangent angle definition equals a 26.8 percent slope). In accordance with the invention, the cross member 100 and its nut devices 128 are fixed to frame 12 to dispose its top and bottom walls 130 and 132 at an angle of approximately 15 degrees relative to the plane of the frame 12, and thus dispose the operating axes 140 and 142 of devices 102 and 104 at an angle of approximately 15 degrees off the vertical when the frame 12 is in its horizontal relation shown in FIG. 1.

In the treadmill apparatus 10, the projecting end 300 of the channel member 40 and the forwardly extending end 306 of the plate 304 have the respective mounting plate structures 309 and 311 affixed thereto and are angled with respect to the plane of the frame 12 at an angle of 75 degrees to achieve the aforementioned angulation of the cross member 100 relative to the horizontal, by the respective mounting plate structures 309 and 311 being suitably affixed to the respective shells 136, as by employing welding, screw type fasteners, or the like. The frame 12 thus defines a downwardly angled forward end portion 310 that lies in a plane that is at an angle of 75 degrees relative to the plane of the basic frame 12, as indicated in FIG. 1. Cross member 100 in treadmill 10 thus is joined in the frame 12 to have its top and bottom walls 130 and 132 perpendicular to the plane of the frame portion 310, but at the indicated angle of approximately 15 degrees relative to the plane of the basic frame 12, as indicated in FIG. 1, in which cross member 100 lies. When frame 12 is at the zero slope position, slope adjusting devices 102 and 104 are disposed at a fifteen degree angulation off the vertical.

As has also been indicated, the respective screw members 120 and 122 are journalled in their respective feet 124 and 126, which are diagrammatically illustrated in FIG. 8 in the specific showing of foot 124. Thus, the threaded members 120 and 122 at their lower ends are formed with a ball terminal portion 320 which is received in the socket 322 of foot 124 that is formed from a suitable plastic material such as nylon or the like. The foot 124 defines a planar sole portion 325 that forms one side of disc portion 326, with the socket 322 being defined by an annular wall structure 328 projecting from the disc portion 326 that tapers upwardly of the disc portion 326 into a resiliently flexible continuous lip 330 which is proportioned such that the ball terminal portion 320 may be snap fitted into the socket 322 for permanent retention of the foot 124 on the ball 320. The foot 124 defines the internal conical surface 334 against which the ball portion 320 rockably and rotatably engages, and upstanding annular wall surface 336 that confines the ball 320 centrally of the foot 124. Lip 330 may be formed with a plurality of spaced marginal notches for facilitating application of the feet 124 and 126 to the respective balls 320.

Thus, the slope adjusting support devices 102 and 104 as equipped with the feet 124 and 126 are rotatably and rockably mounted within the respective feet 124 and 126 which in turn have their undersurfaces 324 in flush engagement with the apparatus supporting surface 340.

The threaded members 120 and 122 at their respective upper ends 166 and 168 are each equipped with a chain drive sprocket 170 over which endless drive chain 172 is trained. The upper ends 166 and 168 of the respective threaded members 120 and 122 are also suitably journalled, as indicated at 174 and 176, in chain drive cover 178.

The cover 178 as illustrated comprises a shield 179 in the form of channel shaped member 180 having web portion 182 in which the upper ends 166 and 168 of the respective threaded members 120 and 122 are journalled, and depending side flanges 184 and 186 which extend downwardly sufficiently from the web portion to overlie and mask drive chain 172. In the form shown, the channel member 180 is of sufficient length to cover both ends of the drive chain 172 as it is disposed in trained relation over the sprockets 170, but if so desired, the cover 178 could be provided with rounded end portions that join the cover flanges 184 and 186 at either end of the cover 178.

The upper end 168 of the threaded member 122 is extended where indicated at 190 and has removably applied to same crank handle 192 comprising hand gripping portion 194 at right angles to stem portion 196 which in turn is suitably removably received in a bore formed in the end portion 190 in close fitting, radial relation thereto.

It will thus be observed that by rotating operating handle 192 about the operating axis 142 of the threaded member 122, both the devices 102 and 104 will be simultaneously operated about their respective operational axes 140 and 142 by way of the coupling provided by drive chain 172 and the cooperating sprockets 170. Thus, the threaded members 120 and 122 may be turned in one direction about their respective axes 140 and 142 to shift the frame 12 from its horizontally disposed position of FIG. 1, in which the devices 102 and 104 are in their retracted relations, to the maximum slope position shown in the phantom line position of FIG. 1, in which the devices 102 and 104 are in their extended relations. As already indicated, the threaded members 120 and 122, in moving from the full line position of FIG. 1 to the phantom line position thereof, rock rearwardly of the threadmill from the upwardly angled relation shown in the full line position of FIG. 1 to the substantially vertical relation shown in the phantom line position of FIG. 1.

Rotation of the threaded members 120 and 122 in the opposite direction returns the treadmill to the full line position of FIG. 1, whereby the devices 102 and 104 are returned from their extended relations to their retracted relations. Regardless of which direction the members 120 and 122 are operated, their threaded connections with the frame cross member 100 through nut devices 128 move the cross member 100 longitudinally of the respective members 120 and 122 to achieve the changes of slope of the treadmill 10 as may be desired.

The frame 12 at its rear end 18 is equipped with a pair of leg structures 200 and 202. In the form diagrammatically illustrated, frame 12 has angle member 201 affixed to the underside of same, as by employing two of the screws or bolts 54 applied to the flange 203 of member 201 for this purpose; angle member 201 has end plates 204 affixed to either end thereof, to each of which is respectively pivotally connected the respective rear feet 205 and 206, as by employing suitable pins 207. Feet 205 and 206 are formed from nylon of the like and have flat floor engaging surfaces 208, and space integral sleeve portions 209 that, for each of the feet 205 and 206, receive the respective pins 207. Frame 12 pivots at pins 207 with respect to feet 205 and 206 in being moved between the positions indicated in FIG. 1. Plates 204 are also each bolted to the frame members 40 and 42, respectively by suitable screw fastener devices 211.

The foot structures 200 and 202 and the feet 124 and 126 of the respective devices 102 and 104 are proportioned such that when the treadmill assembly 10 rests on horizontal supporting surface 340 (that is intended to represent a floor or the like), and the slope adjusting devices 102 and 104 are in their retracted relations, the frame 12 and its slider bed 14 will be horizontally disposed.

It is also to be noted that the pivotal connections of frame 12 that accommodate the zero to maximum slope positions indicated in FIG. 1 are at the feet 124, 126 and 205 and 206. The cross member 100 is a rigidly cohnected part of frame 12, and is rigidly connected to the respective sleeves 136 of the respective nut assemblies 128. Thus, frame 12 is stablely connected to nut assemblies 128 in non-pivotal relation thereto, with the necessary pivotal action needed to accommodate the desired slope positioning of frame 12 taking place as its feet 124, 126, 205 and 206.

The suitable electric drive motor 106, having motor shaft 226, is pivotally connected, at 220, between spaced mounting plates 234, by pin 236 (see FIGS. 1 and 10) for pivotal movement about a pivot axis defined by pin 236. Mounting plates 234 are fixed to side wall 134 of cross member 100 (see FIGS. 3 and 10), with a step drive assembly 222 being provided that is tensioned by tensioning device 223 (see FIG. 10) that is manually releasable for drive adjustment purposes, as will be described. Plates 234 are braced by brace plate 238 fixed between same (see FIG. 10). The motor 106 and its drive shaft 226 comprises a drive motor assembly that is pivotally mounted for pivotal movement about the indicated axis at 220.

The step drive assembly 222 comprises suitable stepping pulley 224 mounted on and keyed to motor shaft 226 in proper coplanar alignment with stepping pulley 64, that is keyed to roller shell 312, with pulley belt 228 being optionally applied to the sets of coplanar related pulley grooves of the pulleys 64 and 224 such that the belt 24 will be driven at one of the speeds indicated, namely 2, 2.9, or 3.5 miles per hour, at the user's option. These speeds are suitable for walking exercise purposes. Flywheel 227 suitably keyed to motor shaft 226 is preferably employed to minimize vibration and smooth out drive power requirements that vary as the user steps along the treadmill when it is operating.

As the belt 24, as formed from the indicated polyester film or oriented nylon, has a coefficient of dynamic friction of about 0.22 or less relative to the slider bed surfacing 30, and the elastomeric crowning of the head and tail rollers provides a coefficient of static friction between such belting 24 and drive roller 20 that is at least about 0.4 in light of the other invention parameters that have been stated being also present, a one-third horsepower motor will satisfy the power requirements for an individual weighing up to about two hundred pounds, using treadmill 10 for walking exercise, for example.

Flywheel 227 provides accumulated power in the form of momentum to keep belt 24 moving relative to slider bed 14 as the user's weight on the belt varies as he strides to stay even with the motion of belt 24. Flywheel 227 for this treadmill application should have a weight in the range of from about 1.5 pounds to about five pounds and a maximum diameter of about five inches for a flywheel thickness of ⅜th inch, with the actual weight and diameter employed depending on how the mass of the flywheel 227 is distributed radially of same.

Affixed to the cross member 100 is bracket 250 in the form of plate 252 that has its lower end 254 affixed to the side wall 134 of the cross member 100, as by employing welding. The plate 252 defines upstanding end portion 256 which is formed with aperture 260 through which extends the threaded shank 262 of screw member 264 which extends through aperture 265 formed in upstanding end 266 of plate 267 that is fixed, as by welding to the motor 106, and specifically its housing 106A. Screw member 264 extends through compression spring 268 and spring seat 269, and is threadedly received through adjusting nut 271 that seats against washer 270 abutting plate end 266. Nut 271 is positioned on screw member 264 to compress spring 268 between plate end portion 256 and spring seat 269 so as to provide tensioning device 223 for giving belt 228 the desired tension. This arrangement provides that belt 228 will operate under constant tension and will not be overstressed, as load surges are absorbed by spring 268. Plate 267 is formed to define handle 272 extending rearwardly of the treadmill so that the user of the treadmill, if he desires to change the driving speed of belt 24, may depress handle 272 downwardly, as indicated in full lines in FIG. 10, to compress spring 268 and fully relieve the tension in pulley belt 228 for ease of changing its position relative to pulleys 64 and 224, with one hand while holding handle 272 depressed with his other hand. On effecting the desired repositioning of pulley belt 228, handle 272 is released for application of tension thereto by device 223. Nut 271 may be adjusted as needed, relative to screw member 264 to apply the desired amount of tension to belt 228. The location of the pivot axis for motor 106 is disposed well below the plane of frame 12, and the common plane of the axes of rotation of motor shaft 226 and head roller shaft 60, to provide the bell crank action needed for this functioning of parts (see FIG. 10).

The hand holds 29 of treadmill 10 each comprise a fixed side railing 280 that is in the form of brace member 282 suitably shaped from rod or pipe stock to define upright legs 284 and rectilinear bight or hand hold portion 286 that are shaped to define a configuration resembling the letter "P", of which head portion 285 defines rearwardly extending loop portion 287. The railings 280 are of tubular metallic structure, with the rear legs 284 being enlarged as at 289 to receive the respective upstanding ends 290 of support 291 that is fixed to frame 12 in the manner suggested in FIGS. 1, 4, 10 and 13, wherein support 291, which also may be of suitable metallic tubular construction, have a pair of angle brackets 292 affixed thereto, as by welding at 293, with the respective brackets 292 being affixed to frame by a set of the aforedescribed screw members 54 having the functions indicated in FIG. 15. The front or forward legs 284 are similarly mounted in place by identical components, as indicated by corresponding reference numerals, side railings 280 being anchored in place by suitable screw fasteners 294 (see FIG. 1).

Figure 4:
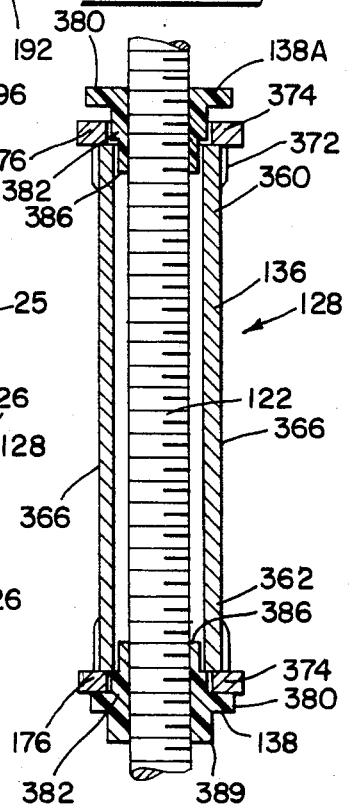
FIG. 4 is a vertical cross-sectional view taken substantially along line 4—4 of FIG. 1, illustrating the general arrangement of the slider bed and belt that is trained over same, and a slider bed hand hold forming side railing, which side railings are disposed, one on either side, of the slider bed frame.

Railings 280 are proportioned in length and outwardly angled as indicated in FIG. 4 so that the user when mounting the treadmill apparatus with the belt 24 moving may grasp the hand hold portion 286 of hand rail 280 at the side of the treadmill that he is mounting it from, facing to the right of FIG. 1, as needed to steady himself, and simultaneously reach over the treadmill 10, while still standing beside it, and grasp the hand hold portion of the other railing 280, and then lift and swing his legs, one at a time, with the leg nearest the treadmill first, onto the belt 24 under the railing loop portion 287. The user may then continue his grasp on the hand hold portions of railings 280 to steady himself, as needed, while working out (walking) on the treadmill.

Figure 7:
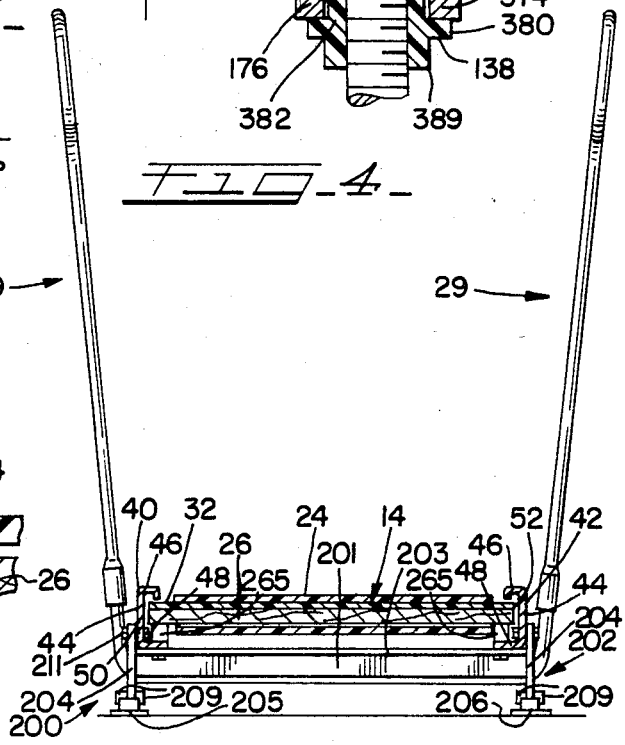
FIG. 7 is a diagrammatic fragmental view taken along line 7—7 of FIG. 1, on an enlarged scale, illustrating the novel nut assembly arrangement that forms a part of the illustrated embodiment.
Figures 10, 11, 12, 13, 14:
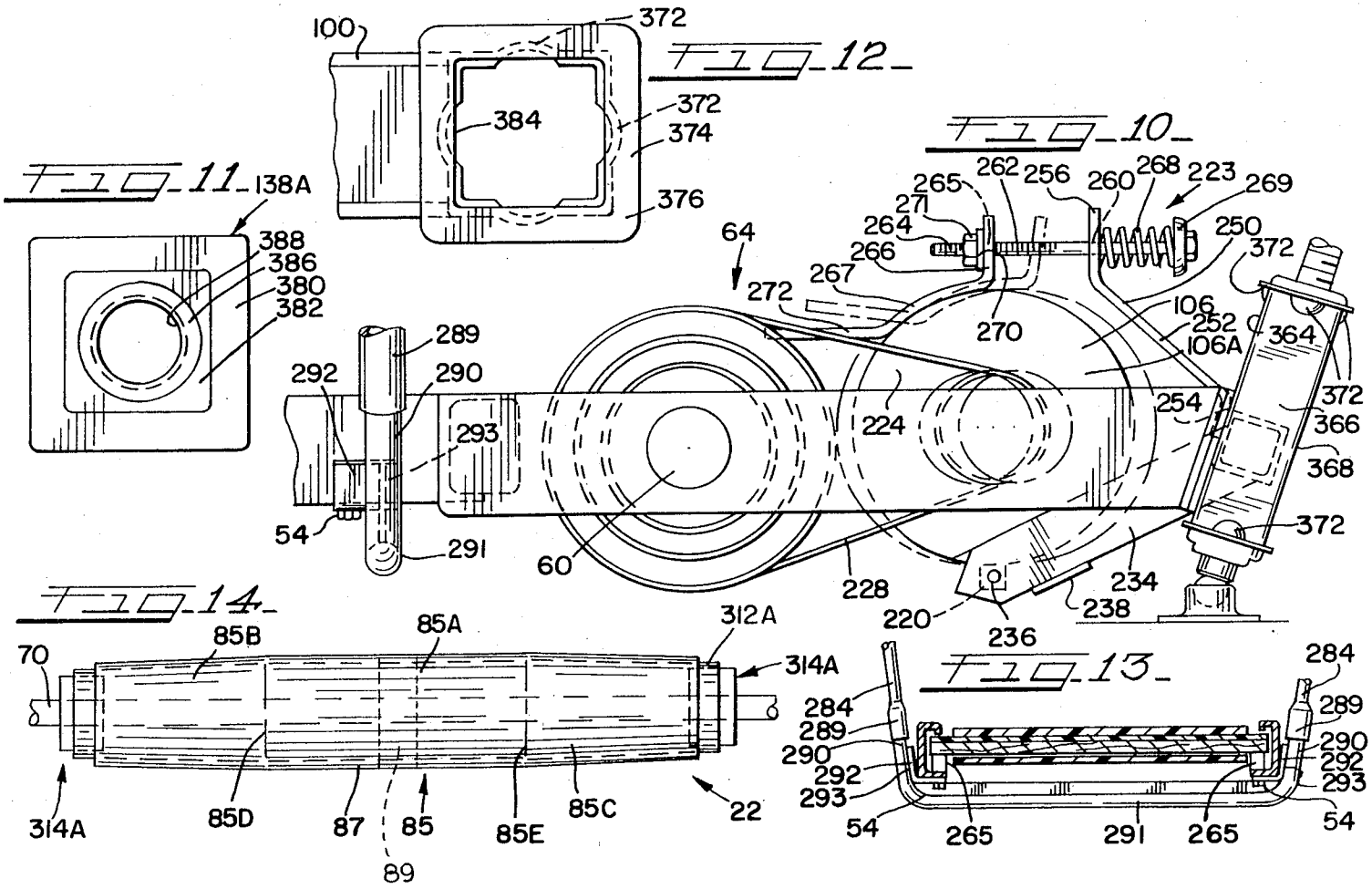
FIG. 10 is a fragmental side elevational view of the head end of the slider bed frame and drive motor assembly associated therewith, on an enlarged scale, and diagrammatically illustrating the spring biased pulley belt tensioning arrangement and manual release therefor that forms a part of the illustrated embodiment.
FIG. 11 is a plan view of one of the nut members involved in the nut assembly of the illustrated embodiment.
FIG. 12 is a top plan view of one of the nut assembly mounting sleeves, with the nut element omitted.
FIG. 13 is a sectional view along line 13—13 of FIG. 1, further illustrating the manner of securing the treadmill hand holds to the slider bed frame.
FIG. 14 is a plan view of the slider bed idler roller.

Referring now more specifically to FIGS. 7, 11 and 12, the sleeves 136 of nut assemblies 128 at their upper and lower ends 360 and 362 are outwardly indented at the midportion of their respective sides 364, 366, 368, and 370, where indicated at 372 to freely accommodate the respective nut elements, which are similar nut 138A being shown in detail in FIG. 11. The sleeves 136 at their respective ends 360 and 362 have fixed to same, as by welding, an open centered plate 374 that is shown in plan in FIG. 12, that form the respective end flanges 376 of sleeves 136 at either end of same. The nut elements 138 and 138A each define quadrilateral flange portion 380 that has marginal dimensioning comparable to the outer marginal dimensioning of plates 374, a quadrilateral stud portion 382 shaped to be substantially complemental to the quadrilaterally contoured open center 384 of plates 374, and a cylindrical stud portion 386 proportioned to fit within the sleeve ends 360 and 362 and that is internally threaded as at 388 for threaded engagement with the respective threaded members 122 and 124. Nut 138 includes cylindrical stud portion 389 of increased wall thickness that extends oppositely of its stud portion 386 to increase its section and threaded engagement with the threaded members 120 or 122 they cooperate with since nuts 138 are primary load bearing components.

The nut assemblies 128 are assembled as indicated in FIG. 7, without having to fix or bond nut elements 138 and 138A to the respective sleeves 136. For this purpose, the threaded members 120 and 122 are threaded through the nuts 138 and 138A of a particular assembly 128, with the parts thereof oriented as suggested in FIGS. 1, 3, 7 and 10, with the result that cross member 100 rests on the lower nut elements 138 through its sleeves 136, and the nuts 138A are free to float longitudinally of the respective threaded member, axes 140 and 142, with respect to their sleeves 136, to accommodate tolerance variations in the formation of the threading of the steel members 120 and 122, as well as the differences in the coefficients of thermal expansion of the nut elements and steel. The nut elements 138A thus normally may have their flange portions 380 spaced somewhat from the sleeve upper end flanges 376, in accommodating such variations, which permit the use of any suitable rolled threading in forming threaded members 120 and 122. The outward indentations 372 of sleeves shape same to freely receive the nut element stud portion 386. Nut elements 138 and 138A are preferably formed from a suitable self lubricating material, such as the aforeindicated nylon.

It will be apparent that in the apparatus 10, rotation of operating handle 192 about the axis 142 of threaded member 122 will simultaneously operate both the slope adjusting support devices 102 and 104 in the manner already described. Thus, the threaded members 120 and 122 of the apparatus 10 may be turned in one direction about the respective axes 140 and 142 to shift the frame 12 from its horizontally disposed full line position of FIG. 1, in which the device, 102 and 104 are in their retracted relations, to the maximum slope position shown in the phantom line showing of FIG. 1, in which the devices 102 and 104 are in their extended relations, and frame 12 is disposed at an approximate 15 degree angulation with respect to the horizontal, with its frame portion 310 substantially vertically disposed and the threaded members 120 and 122 of the respective devices 102 and 104 positioned substantially vertically, and having been rocked rearwardly of the treadmill from their upwardly angled relation shown in the full line position of FIG. 1.

Operation of the devices 102 and 104 in the opposite direction rotates the threaded member 120 and 122 thereof in the opposite direction to return the treadmill to its full line relation indicated in FIG. 1, whereby the devices 102 and 104 are returned from their extended relations to the retracted relations.

As is clear from the application drawings, the treadmil front feet 124 and 126, and rear feet 205 and 206 are not physically connected to the floor surface 340, but do rest on same. Also, frame 12 is not pivotally connected to cross member 100, but rather is rigidly connected thereto, with the sleeves 136 of nut assemblies 128 resting on nuts 138, for stability, as already described. The pivotal action in frame 12 that accommodates its changes in slope occur only at the pivotal connections of feet 124 and 126 to the respective threaded members 120 and 122, and at the pivotal connections of feet 205 and 206 to the respective plates 204.

It has been found that when the frame 12 is moved from its horizontal position to its maximum slope position, while front feet 124 and 126 remain stationary, rear feet 205 and 206 slide forwardly a short distance, approximately $1\frac{3}{4}$ inch in a successful embodiment of the invention, as indicated by the showing of FIG. 1. Thus, the special nature of Applicant's treadmill 10 requires that its rear feet 205 and 206 be in free sliding on floating relation to the floor surface 340 supporting treadmill 10.

It will thus be seen that the treadmill assembly of the present invention provides a simplified, complication free exercise apparatus suitable for walking exercise at the pace and slope rate desired by the user. The slide bed and frame construction therefor are of minimal and simplified components arranged for ready securement together, economical electric energy driving requirements, and rugged resistance to hard use. Jugging or trotting use may be provided for by providing a drive apparatus that will move the belt 24 at selected speeds of up to eight miles per hour.

The assemblies 10 and 10A require no instrumentation, and the adjustable simplified nature of the belt drive permits ease of manual adjustment for speed changes and off-on operation, and provides a constant and uniform tension on the drive pulley belt which is freed from overstressing possibilities. The simple slider bed surface for the belt provides coefficient of dynamic friction characteristics that are lower than of canvas slider bed surfacings even where coated or impregnated with wax, graphite, or the like, while also eliminating the messiness that can accompany the use of such materials; canvas serving as slider bed material also tends to wrinkle as it wears, thus further increasing undesirably high coefficient friction relationships where they should be low.

The disclosed materials for forming belt 24 and slider bed surface 30 provide treadmill belt and slider bed combinations that will have coefficients of dynamic friction that will equal or be less than the 0.22 figure I have found to be critical for achieving the objects of the invention, with approximately 0.2 being available where the belting is formed from the indicated polyester film products.

The elastomeric materials disclosed herein for forming the belt head roller crowning increase the static coefficient of friction of this roller relative to the belt, for the belt forming materials hereindisclosed, to levels (about 0.4 or more) that, with the indicated minimized coefficient of dynamic friction levels of the belt riding on the treadmill slider bed surface 30, and the other stated parameters of the invention being present insure minimum bearing stresses of rollers 20 and 22, and minimized drive energy requirements for treadmill 10, permitting the use of a treadmill drive motor of under one horsepower.

The low long term creep or stretch resistance of the specified belt forming plastic materials is a fundamentally important factor in maintaining the proper relation of the belting to the rollers and slider bed over which it is trained, for long term use of the treadmill.

The front and rear supporting feet for the assembly 10 in the zero slope position of FIG. 1 are highly effective in maintaining stability in use, with the angulation of the threaded members 120 and 122 in the zero slope position of the apparatus being of no significant effect due to the disposition of the cross member 100 in close adjacency to the feet of devices 102 and 104. As the treadmill apparatus is elevated to its maximum slope position, the slope adjusting devices 102 and 104 shift toward and to the stabilizing and vertically disposed position indicated in the phantom showing of FIG. 1.

Operation of the slope adjusting devices 102 and 104 is easy and effective, with the threaded mounting of the threaded members 120 and 122 in the cross member 100 and the journaling of their upper ends in cover 178 maintaining the threaded members 120 and 122 in uniform spaced apart parallel relation for effective simultaneous operational movement about their respective axes 140 and 142.

The proportioning and simplified nature of the threadmill assemblies 10 and 10A makes it practical for the individual user to use and store same in his home. Shifting of the assembly is easily done by picking up the head end of same and pushing or pulling as needed.

While the belt sheeting 24S is preferably of the extruded film or sheet configuration illustrated, woven sheeting formed from the same materials may also be employed. Further, the sheeting may also be in the form of laminated films.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a walking exercise treadmill that includes a generally planar slider bed frame a head end and a tail end, with the slider bed frame defining a slider bed having a flat top surfacing extending substantially between said frame ends and defining an upwardly facing slider surface, a head roller journalled in said frame adjacent said frame head end, a tail roller journalled in said frame adjacent said frame tail end, an endless belt trained over the head and tail rollers and the slider bed frame, including an upper belt run overlying and riding on the slider bed top surfacing, and a lower run disposed under the slider bed between the ends thereof, and means for driving said belt for movement of the belt upper run from the slider bed head end to the slider bed tail end across and along the slider bed slider surfacing and for movement of the belt lower run between the slider bed ends, the improvement wherein slippage of the belt at the rollers for walking exercise use of the treadmill is avoided for users of up to about two hundered pounds of weight when the said belt driving means is actuated by an electric motor of no more than about one horsepower, said improvement comprising:

the belt being formed by an oriented plastic material of low long term stretch resistance characteristics, and having a thickness lying in the range of from about 0.010 inch to about 0.030 inch, with the treadmill rollers being formed from a rigid metallic material and each having a belt centering crown, with said crown of the head roller having a dimension lengthwise of the head roller that approximates the width of the belt and being formed from an elastomeric material, and with said crown of the tail roller having a dimension lengthwise of the tail roller that approximates the width of the belt and is of corrosion resistant characteristics, with rollers being disclosed adjacent the respective ends of the slider bed frame in essentially oppositely disposed bend roller relation to the belt, with the tail roller being journalled in said frame, adjacent the tail roller respective ends, beyond said crown thereof by separate bearing devices that are mounted for independently adjusting the tail roller ends in a distance range longitudinally of the slider bed frame for centering the belt when moving relative to the slider bed frame with the belt side edges engaging the crown surfacing of the respective head and tail rollers for correct tracking of the belt relative to the slider bed and the head and tail rollers when the belt is moved relative thereto, with the head roller being journalled in said frame, adjacent the head roller respective ends, by bearing devices that are secured with respcet to said frame, with the belt having a coefficient of static friction relative to said head roller crown that is at least approximately 0.4, and the belt having a coefficient of dynamic friction relative to the bed surfacing that is no more than about 0.22, with the slider bed surfacing being lubricant free, with the belt being tensioned against the rollers in slip free relation thereto under a pull force acting to bias the rollers toward each other that is in the range of from about one hundered pounds to about two hundred fifty pounds, said distance range of the tail roller separate bearing devices be proportioned for stretching each run of the belt, adjacent the belt midportion, up to about one inch, while maintaining said pull force in said range thereof, and with the driving means including means for coupling said motor to the head roller for the driving of the belt thereby.

2. The improvement set forth in claim 1 wherein:

the slider bed frame surfacing comprises sheeting formed from said elastic material of substantially uniform thickness, across its width and along its length, and lying in the range of from about 0.005 inch to about 0.015 inch.

3. The improvement set forth in claim 2 wherein:

the belt is formed from polyester film sheeting.

4. The improvement set forth in claim 2 wherein:

the belt is formed from oriented nylon sheeting.

5. The improvement set forth in claim 1 wherein:

the slider bed frame surfacing comprises hardboard of the steam exploded wood chip compressed fiber material type.

6. The improvement set forth in claim 5 wherein:

the belt is formed from polyester film sheeting.

7. The improvement set forth in claim 5 wherein:

the belt is formed from oriented nylon sheeting.

8. The improvement set forth in claim 1 wherein:

the plastic material forming the belt is substantially homogenious in nature and has substantially uniform thickness, across its width and along its length, lying in its said thickness range thereof.

9. The improvement set forth in claim 1 wherein:

the plastic material is a woven sheeting having a thickness lying in said thickness range thereof.

10. The imorovement set forth in claim 8 wherein:

the plastic material forming the belt comprises laminated films formed from said plastic material.

11. The improvement set forth in claim 1 werein:

said elastomeric material is urethane in a coating of film thickness dimensions, about the head roller to form said crown thereof.

12. The improvement set forth in 1 wherein:

said elastomeric material is molded in place to form said head roller crown.

13. The improvement set forth in claim 1 wherein:

said elastomeric material is wax free nitrile rubber.

14. The improvement set forth in claim 1 wherein:

said crown of the tail roller is interrupted thereabout for electrically grounding the belt to the tail roller.

15. The improvement set forth in claim 1 wherein:

the crowns of the rollers, respectively, are of right cylinder configuration at the midportions thereof and of frusto-conical configuration at the end portions thereof having their larger ends merging with said cylindrical crown portions of the rollers respectively.

16. The improvement set forth in claim 1 wherein:

the slider bed has a first hand rail structure secured thereto on one side of same, and a second hand rail structure secured thereto at the other side of same, said hand rail structures being substantially aligned transversely of said slider bed and being of like "P" configuration with the head thereof being directed rearwardly of and in cantilever relation to said slider bed, and being located adjacent the midlength portion of said belt upper run, said hand rail heads being disposed above and to either side of said belt upper run midlength portion whereby the treadmill user may mount the treadmill from one side thereof by grasping both of said hand rail heads and swinging his legs one at a time up onto said belt under the said head at said one side of the treadmill.

17. The improvement set forth in claim 1 wherein:

the driving means includes flywheel means driven by said motor for smoothing out power requirement demands on said motor for driving the belt under the striding action of the user on the belt.

* * * * *